US008784154B2

(12) United States Patent
Chuang

(10) Patent No.: US 8,784,154 B2
(45) Date of Patent: Jul. 22, 2014

(54) TOY FIGURE WITH RECIPROCALLY MOVABLE LIMB

(75) Inventor: Peter Chuang, Irvine, CA (US)

(73) Assignee: Mattel, Inc., El Segundo, CA (US)

( * ) Notice: Subject to any disclaimer, the term of this patent is extended or adjusted under 35 U.S.C. 154(b) by 654 days.

(21) Appl. No.: 12/952,961

(22) Filed: Nov. 23, 2010

(65) Prior Publication Data

US 2012/0129422 A1 May 24, 2012

(51) Int. Cl.
*A63H 13/00* (2006.01)
*A63H 3/46* (2006.01)

(52) U.S. Cl.
USPC ..... 446/354; 446/376

(58) Field of Classification Search
USPC ..... 446/268, 330, 336, 376, 390, 353, 354
See application file for complete search history.

(56) References Cited

U.S. PATENT DOCUMENTS

| | | | | |
|---|---|---|---|---|
| 1,364,388 | A | 1/1921 | Lemke | |
| 1,594,649 | A | 8/1926 | Trautmann | |
| 1,621,574 | A | 3/1927 | Babbitt | |
| 1,650,784 | A | 11/1927 | Babbitt | |
| 1,802,884 | A | 4/1931 | Diederichs | |
| 2,151,546 | A | 3/1939 | Arnold | |
| 2,296,541 | A * | 9/1942 | Schuyler | 40/419 |
| 2,424,607 | A | 7/1947 | Fisher | |
| 2,506,328 | A * | 5/1950 | Alger | 446/98 |
| 2,604,727 | A | 7/1952 | Swenson | |
| 2,799,501 | A * | 7/1957 | Barbolla | 273/317.3 |
| 2,911,758 | A * | 11/1959 | Carson | 446/308 |
| 2,918,738 | A | 12/1959 | Barr | |
| 3,061,972 | A | 11/1962 | Wigal | |
| 3,098,319 | A | 7/1963 | Ellis | |
| 3,178,853 | A | 4/1965 | Greenwood et al. | |
| 3,210,886 | A | 10/1965 | Glass et al. | |
| 3,232,003 | A | 2/1966 | Doe | |
| 3,354,577 | A | 11/1967 | Glass et al. | |
| 3,425,153 | A * | 2/1969 | Crosman et al. | 446/308 |
| 3,452,472 | A * | 7/1969 | Glass et al. | 446/336 |
| 3,453,772 | A | 7/1969 | Schneider | |
| 3,475,854 | A | 11/1969 | Ryan et al. | |
| 3,529,479 | A | 9/1970 | Ryan et al. | |
| 3,566,537 | A * | 3/1971 | Tepper et al. | 446/308 |
| 3,583,096 | A | 6/1971 | Stubbmann | |
| 3,600,848 | A | 8/1971 | Marshall et al. | |
| 3,603,029 | A | 9/1971 | Nutting | |
| 3,613,299 | A | 10/1971 | Amici et al. | |
| 3,650,065 | A | 3/1972 | Johmann | |
| 3,653,152 | A | 4/1972 | Levine | |

(Continued)

FOREIGN PATENT DOCUMENTS

| | | |
|---|---|---|
| EP | 000201626 A2 | 11/1986 |
| GB | 2263816 A | 8/1993 |
| JP | 2003-10563 | 1/2003 |

*Primary Examiner* — Gene Kim
*Assistant Examiner* — Alyssa Hylinski
(74) *Attorney, Agent, or Firm* — Edell, Shapiro & Finnan LLC

(57) ABSTRACT

A toy figure includes a body, an arm movably coupled to the body, and a drive mechanism coupled to the arm. The drive mechanism moves the arm along a first path of motion between a first position and a second position during a first segment of a movement cycle, and the drive mechanism moves the arm along a second path of motion between the second position and a third position during a second segment of the movement cycle.

13 Claims, 15 Drawing Sheets

(56) References Cited

U.S. PATENT DOCUMENTS

| | | | | | |
|---|---|---|---|---|---|
| 3,672,096 | A | * | 6/1972 | Johmann | 446/338 |
| 3,698,127 | A | | 10/1972 | Harp | |
| 3,728,816 | A | * | 4/1973 | Ensmann et al. | 446/336 |
| 3,758,982 | A | | 9/1973 | Lemelson et al. | |
| 3,779,556 | A | * | 12/1973 | Johmann | 273/243 |
| 3,796,284 | A | | 3/1974 | Zeigner et al. | |
| 3,834,071 | A | | 9/1974 | Terzian et al. | |
| 3,851,418 | A | * | 12/1974 | Barlow et al. | 446/338 |
| 3,859,749 | A | | 1/1975 | Morin et al. | |
| 3,862,513 | A | | 1/1975 | Isaacson et al. | |
| 3,867,785 | A | | 2/1975 | Ryan et al. | |
| 4,018,002 | A | | 4/1977 | Holden | |
| 4,031,657 | A | | 6/1977 | Crosman et al. | |
| 4,114,309 | A | | 9/1978 | Gay | |
| 4,135,328 | A | | 1/1979 | Yamasaki | |
| 4,185,412 | A | * | 1/1980 | Rahmstorf | 446/98 |
| 4,224,759 | A | | 9/1980 | Saint-Pierre et al. | |
| 4,236,343 | A | | 12/1980 | Wildman | |
| 4,262,445 | A | * | 4/1981 | Orenstein | 446/308 |
| 4,277,909 | A | | 7/1981 | Rainwater | |
| 4,301,615 | A | | 11/1981 | Ikeda | |
| 4,339,889 | A | | 7/1982 | Guerrero et al. | |
| 4,365,437 | A | | 12/1982 | Jameson | |
| 4,413,441 | A | | 11/1983 | Hunter et al. | |
| 4,457,098 | A | | 7/1984 | Tsuzuki | |
| 4,529,391 | A | | 7/1985 | Hoshino et al. | |
| 4,555,237 | A | | 11/1985 | Nikaido | |
| 4,576,583 | A | | 3/1986 | Yoneda | |
| 4,614,504 | A | | 9/1986 | Yamasaki | |
| 4,623,318 | A | | 11/1986 | Tsiknopoulos et al. | |
| 4,655,725 | A | | 4/1987 | Torres | |
| 4,655,727 | A | | 4/1987 | Swisher et al. | |
| 4,676,763 | A | | 6/1987 | Saito et al. | |
| 4,840,242 | A | | 6/1989 | Chih et al. | |
| 4,881,621 | A | | 11/1989 | Ishida | |
| 4,897,070 | A | | 1/1990 | Wagstaff | |
| 4,985,008 | A | * | 1/1991 | Price | 446/308 |
| 5,011,448 | A | | 4/1991 | Asano | |
| 5,030,161 | A | * | 7/1991 | Pastor | 446/298 |
| 5,046,987 | A | | 9/1991 | Djordjevic | |
| 5,295,893 | A | | 3/1994 | Chiu | |
| 5,306,199 | A | | 4/1994 | Locricchio | |
| 5,320,573 | A | | 6/1994 | Matsuyama | |
| 5,356,326 | A | | 10/1994 | Ting | |
| 5,376,039 | A | | 12/1994 | Balgin | |
| 5,378,189 | A | | 1/1995 | Chiu | |
| 5,423,708 | A | | 6/1995 | Allen | |
| 5,474,486 | A | | 12/1995 | Chilton et al. | |
| 5,498,193 | A | | 3/1996 | Locricchio | |
| 5,501,628 | A | | 3/1996 | Simmel et al. | |
| 5,626,505 | A | | 5/1997 | Cheng | |
| 5,628,668 | A | | 5/1997 | Takemae | |
| 5,695,382 | A | * | 12/1997 | Lin | 446/354 |
| 5,823,845 | A | * | 10/1998 | O'Berrigan | 446/234 |
| 5,989,036 | A | * | 11/1999 | Schwartz | 434/263 |
| 6,004,185 | A | | 12/1999 | Rehkemper et al. | |
| 6,012,962 | A | | 1/2000 | Arriola | |
| 6,062,941 | A | * | 5/2000 | Cook | 446/352 |
| 6,106,359 | A | | 8/2000 | Arriola | |
| 6,123,598 | A | | 9/2000 | Cook | |
| 6,132,285 | A | | 10/2000 | Feldman | |
| 6,142,845 | A | | 11/2000 | Feldman | |
| 6,171,169 | B1 | * | 1/2001 | Saunders | 446/308 |
| 6,190,230 | B1 | | 2/2001 | Hou | |
| 6,238,264 | B1 | | 5/2001 | Kazami et al. | |
| 6,247,993 | B1 | | 6/2001 | Feldman | |
| 6,296,543 | B1 | | 10/2001 | Andrews | |
| 6,500,044 | B1 | | 12/2002 | Sasuga et al. | |
| 6,558,224 | B2 | | 5/2003 | Chan | |
| 6,602,106 | B2 | | 8/2003 | Cheung | |
| 6,645,036 | B1 | | 11/2003 | Lund et al. | |
| 6,648,720 | B1 | | 11/2003 | Domingues | |
| 6,652,352 | B1 | | 11/2003 | MacArthur et al. | |
| 6,699,098 | B1 | | 3/2004 | Kau | |
| 6,837,769 | B1 | * | 1/2005 | Skov et al. | 446/139 |
| 6,866,557 | B2 | | 3/2005 | Randall | |
| 6,918,590 | B2 | | 7/2005 | Annis et al. | |
| 7,063,588 | B2 | | 6/2006 | Kaneko et al. | |
| 7,066,782 | B1 | | 6/2006 | Maddocks et al. | |
| 7,258,591 | B2 | | 8/2007 | Xu et al. | |
| 7,422,506 | B2 | * | 9/2008 | Lund et al. | 446/324 |
| 2006/0014470 | A1 | | 1/2006 | Takahashi et al. | |
| 2008/0188159 | A1 | | 8/2008 | Lund et al. | |
| 2009/0137186 | A1 | | 5/2009 | Willett et al. | |

* cited by examiner

TOY FIGURE WITH RECIPROCALLY MOVABLE LIMB

FIELD OF THE INVENTION

The present invention relates to a toy figure including a limb reciprocally movable along first and second differing paths of motion during a movement cycle.

BACKGROUND OF THE INVENTION

Various toy figures having movable components are known in the art. Toy vehicles and wheeled figures movable via spring or electric motors are also known in the art. Most of those designs typically provide for relatively limited motion patterns, such as the rotation of wheels along a support surface. Other designs provide for more complex motion pattern, such as remote controlled toy vehicles or walking toys. However, such designs are relatively complex, relying upon numerous motors and complex internal control systems. Therefore, there is a need for a toy figure including multiple motion patterns, and which has a relatively simple drive mechanism for actuating its motion patterns.

SUMMARY OF THE INVENTION

The present invention is directed to a toy figure including a body, an arm movably coupled to the body, and a drive mechanism coupled to the arm. In one implementation, the drive mechanism includes a spring-biased pull string. The drive mechanism reciprocally moves the arm along a first path of motion during a first movement cycle, and along a second path of motion during a second movement cycle following the first movement cycle. The second path of motion differs from the first path of motion.

In one embodiment, the first path of motion has a first distance, and the second path of motion has a second distance greater than the first distance. In one implementation, the first path of motion extends between a first arm position and a second arm position, and the second path of motion extends between the second arm position and a third arm position. Initiation of the first movement cycle is restricted until the arm is disposed in its first arm position.

In one embodiment, the toy figure also includes an accessory detachably coupled to the arm. The accessory is detachably coupled to the arm during the first movement cycle. The accessory is detached from and launched by the arm during the second movement cycle. In one implementation, a hand is connected to the arm, and the accessory is a hat detachably mounted on the hand.

The present invention is also directed to a toy figure including a body having an upper portion and a lower portion, a limb movably coupled to the upper portion of the body, and a drive mechanism. The drive mechanism includes a first drive member reciprocally moving the limb relative to the upper portion, and a second drive member reciprocally moving the upper portion relative to the lower portion.

In one embodiment, the drive mechanism simultaneously moves the limb via the first drive member and the upper portion via the second drive member. In one implementation, the first drive member reciprocally moves the limb along a first travel path at a first speed, and the second drive member reciprocally moves the upper portion along a second travel path at a second speed differing from the first speed. In one implementation, the first speed is greater than the second speed.

In one embodiment, the limb pivots about a first axis during movement thereof, and the upper portion pivots about a second axis during movement thereof. The first axis is substantially perpendicular to the second axis.

The present invention is also directed to a toy figure including a body, an arm movably coupled to the body, and a drive mechanism coupled to the arm. The drive mechanism moves the arm along a path of motion during a first segment of a movement cycle from a first position to a second position, and along another path of motion during a second segment of the movement cycle from the second position to a third position. During the first segment of the movement cycle, the arm moves from the first position to the second position and then back to the first position. During the second segment of the movement cycle, the arm moves from the second position to the third position. In one implementation, the arm reciprocates back and forth from the first position to the second position during the first segment of the movement cycle at least twice.

In one embodiment, the toy figure further includes an accessory detachably coupled to the arm. The accessory is detachably coupled to the arm during the first segment of the movement cycle. The accessory is detached from and launched by the arm during the second segment of the movement cycle.

In one embodiment, the toy figure further includes a head coupled to the body, and a hand coupled to the arm. The accessory may be a hat selectively mountable on the head or on the hand.

In one embodiment, the drive mechanism includes a cam having a first portion and a second portion, and a cam follower. The cam follower engages the first portion of the cam during the first segment of the movement cycle. The cam follower is aligned with the second portion of the cam during the second segment of the movement cycle.

In one embodiment, initiation of the movement cycle is restricted unless the arm is disposed in its first position. In one implementation, the arm is biased toward its third position via a resilient member.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer," "horizontal," "vertical," and the like as may be used herein, merely describe points or portions of reference and do not limit the present invention to any particular orientation or configuration. Further, terms such as "first," "second," "third," etc., merely identify one of a number of portions, components, directions and/or points of reference as disclosed herein, and do not limit the present invention to any particular configuration or orientation.

Figure 1:
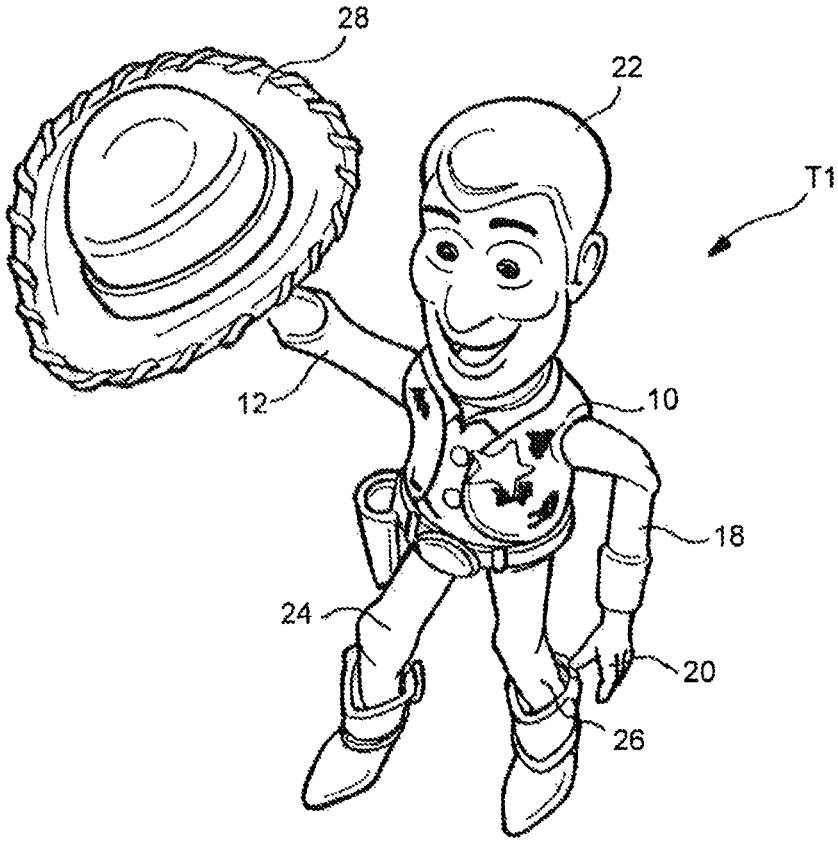
FIG. 1 illustrates a front perspective view of a toy figure according to an embodiment of the present invention.
Figure 2:
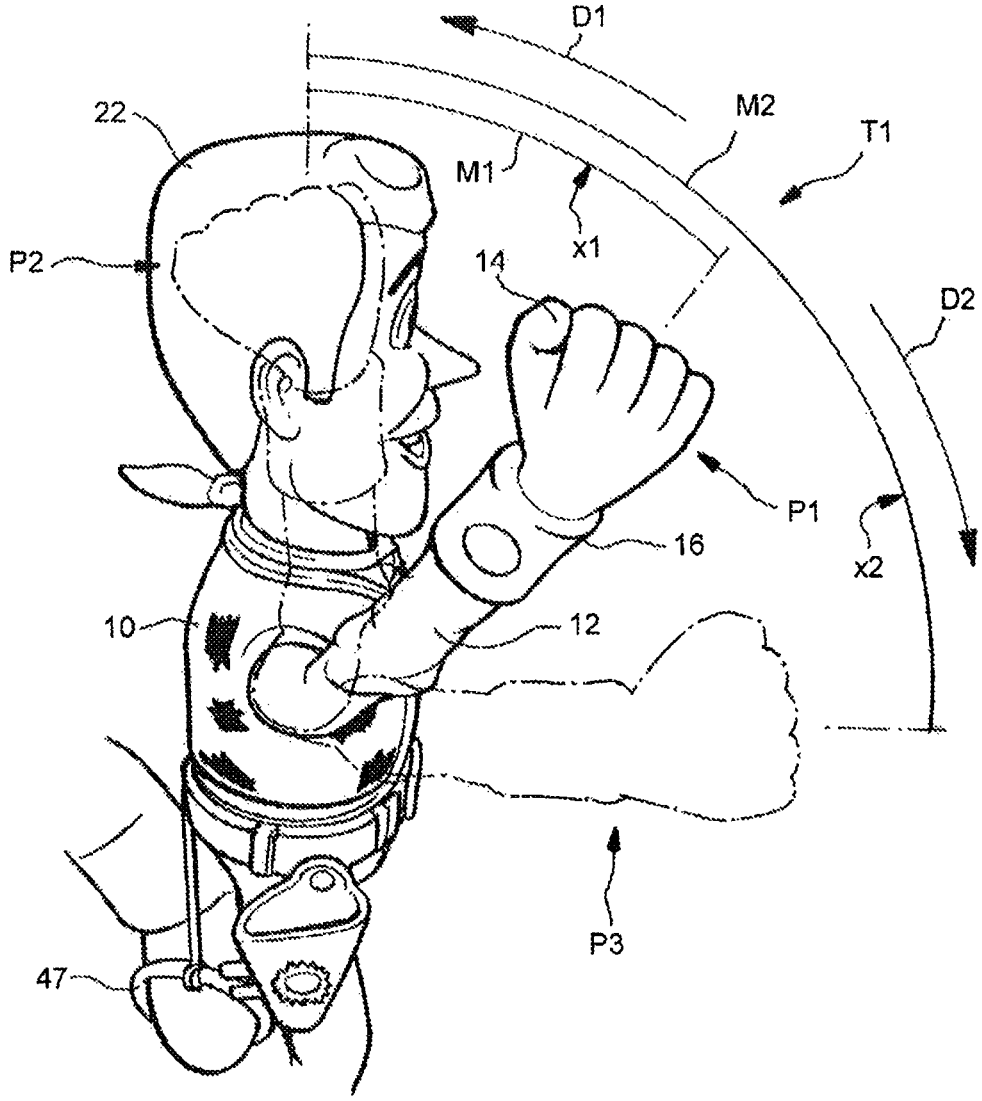
FIG. 2 illustrates a side perspective view of the toy figure of FIG. 1.

FIG. 1 illustrates a toy figure T1 according to an embodiment of the present invention. The figure T1 includes a torso 10, an arm 12 movably coupled to the torso 10. Referring to FIG. 2, the arm 12 is movable between a first arm position P1 and a second arm position P2, and between the second arm position P2 and a third arm position P3 via a drive assembly 40 (shown in FIG. 4 and described in further detail below). The first arm position P1 is in between the second arm position P2 and the third arm position P3. Thus, during operation, the arm 12 moves in a direction D1 from its first arm position P1 to its second arm position P2, and in a second opposite direction D2 from its second arm position P2 back to its first arm position P1. The arm 12 also moves in direction D2 from its second arm position P2 through its first arm position P1 and to its third arm position P3.

With continued reference to FIG. 2, a first path of motion M1 is defined by and extends between the first arm position P1 and the second arm position P2. A second path of motion M2 is defined by and extends between the second arm position P2 and the third arm position P3. In one embodiment, the first path of motion M1 has a distance x1, and the second path of motion M2 has another distance x2 greater than the distance x1 of the first path of motion M1.

The arm 12 is reciprocally movable between its first arm position P1 and its second arm position P2 during a first segment of its movement cycle. Thus, the arm 12 moves back and forth between its first arm position P1 and its second arm position P2 in opposing directions D1, D2 and along the first path of motion M1 a predetermined number times. The arm 12 is then movable along its second path of motion M2 in direction D2 from its second arm position P2 to its third arm position P3 during a second segment of its movement cycle, the second segment of the movement cycle following the first segment of the movement cycle.

Referring again to FIGS. 1 and 2, the arm 12 includes a hand 14 connected to a distal end 16 thereof. Another arm 18 is also coupled to the torso 10, which also includes an associated hand 20 connected thereto. The toy figure T1 also includes a head 22 connected to the torso 10, and legs 24, 26 connected to the torso 10. As illustrated, the toy figure T1 is configured to resemble a stylized cowboy character. In other embodiments, the toy figure T1 may have alternative configurations and/or themes.

Figure 3:
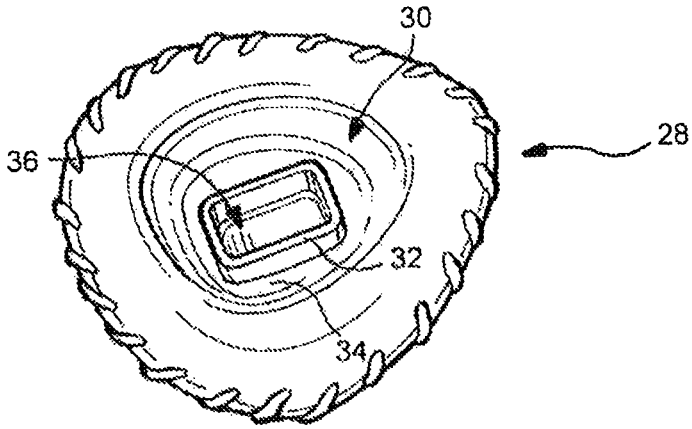
FIG. 3 illustrates a bottom perspective view of a hat mountable on the toy figure of FIG. 1.

In one embodiment, the toy figure T1 includes an accessory detachably coupleable to the arm 12. In one implementation, the accessory is a hat 28. The hat 28 is selectively mountable on the head 22 or on the hand 14. Referring to FIG. 3, the hat 28 includes a cavity 30 configured to receive the head 22 of the toy figure T1. In one implementation, a wall 32 extends upwardly from a base 34 of the cavity 30 and defines a receptacle 36 configured to receive at least a portion of the hand 14. The receptacle 36 has an area larger than the portion of the hand 14 received therein, so that the hat 28 rocks back and forth but is retained on the hand 14 as the arm 12 moves between its first arm position P1 and its second arm position P2 during the first segment of its movement cycle.

As shown in FIG. 1, the hat 28 may be detachably mounted on the hand 14 of the arm 12. The hat 28 is detached from the hand 14 and launched or tossed by the arm 12 during the second segment of the movement cycle when the arm 12 moves from its second arm position P2 to its third arm position P3.

Figure 4:
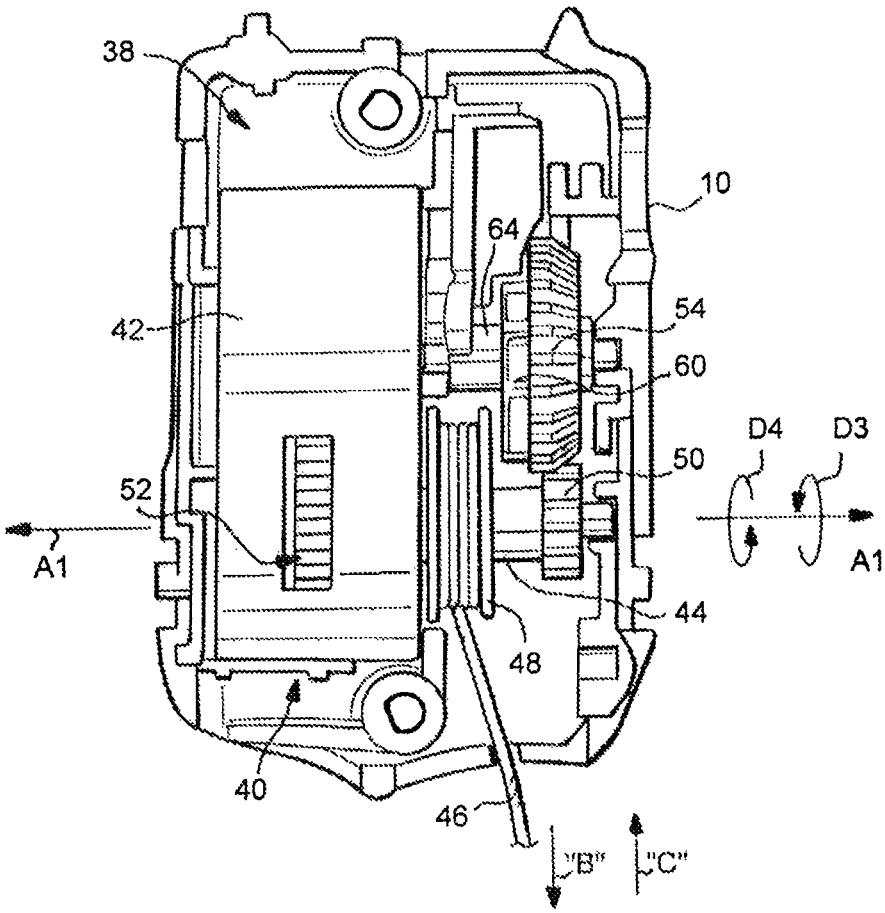
FIG. 4 illustrates a perspective view of internal components within a cavity of the torso of the toy figure of FIG. 1.

Referring to FIG. 4, only a portion of the torso 10 is illustrated with the other portion of the torso 10 removed. The torso 10 defines a cavity 38 configured for housing the drive assembly 40. In one embodiment, the drive assembly 40 includes a housing 42 and a drive wheel 44 rotatable relative to the housing 42. In one embodiment, the drive assembly 40 includes a spring-biased pull string 46. The drive wheel 44 includes a spool portion 48 around which the pull string 46 is coiled, and a drive gear 50 coupled to and extending outwardly from the spool portion 48. A distal end of the pull string 46 may be attached to a pull member 47 (shown in FIG. 2) configured to be grasped by a user when uncoiling the pull string 46 from the spool portion 48. The drive wheel 44 is rotatably biased in a direction D3 about an axis of rotation A1 via a resilient member, such as a spring, which is disposed within the housing 42. The pull string 46 may be pulled outwardly along the direction of arrow B and uncoiled from the spool portion 48, thereby causing the drive wheel 44 to rotate in an opposite direction D4 about its rotational axis A1 against the biasing force of the spring. Upon release of the pull string 46, the pull string 46 moves along the direction of arrow C and is recoiled around the spool portion 48, and the drive wheel 44 is rotated in its biased direction D3 about its rotational axis A1. The rotational speed of the drive wheel 44 is determined in part by the biasing force of the spring, as well an internal gearing arrangement 52 disposed within the housing 42 and coupled to the drive wheel 44.

Figure 5:
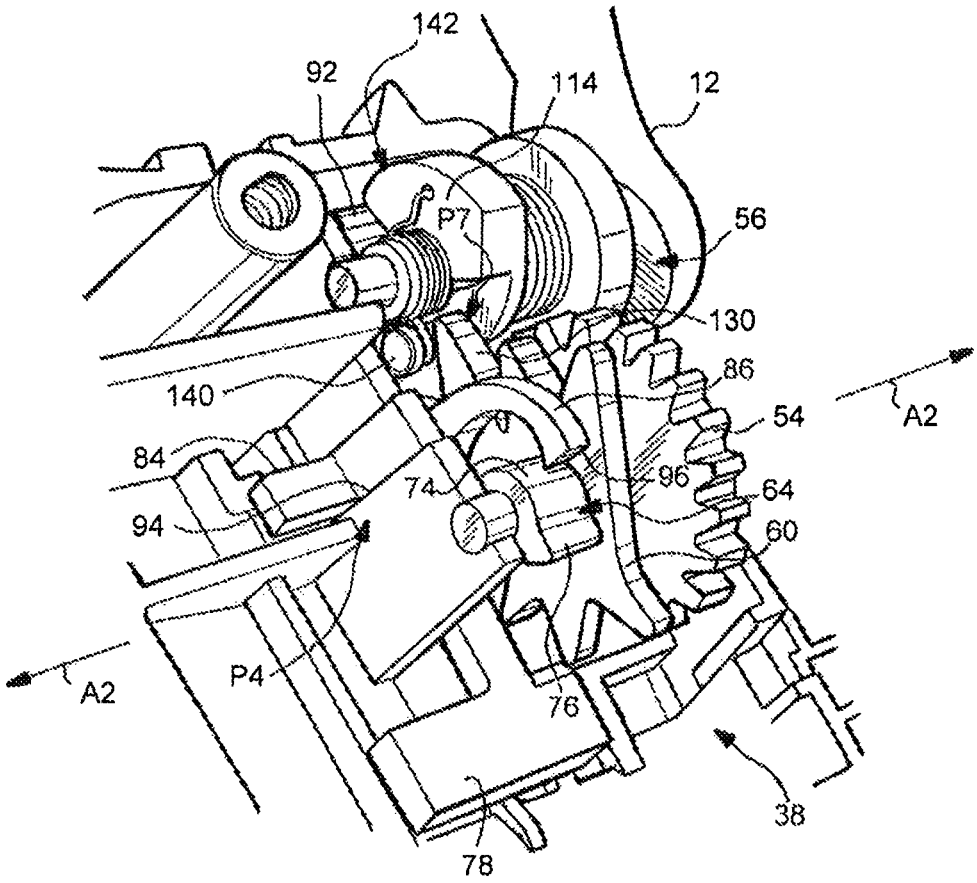
FIG. 5 illustrates a perspective view of some of the components shown in FIG. 4.

The drive assembly 40 also includes a central gear 54, which is coupled to and rotatable by the drive gear 50 upon rotation of the drive wheel 44. Referring to FIG. 5, the central gear 54 in turn is coupled to an end portion 56 of the arm 12 that is disposed within the cavity 38. Thus, the drive assembly 40 is coupled to the arm 12.

Figure 6:
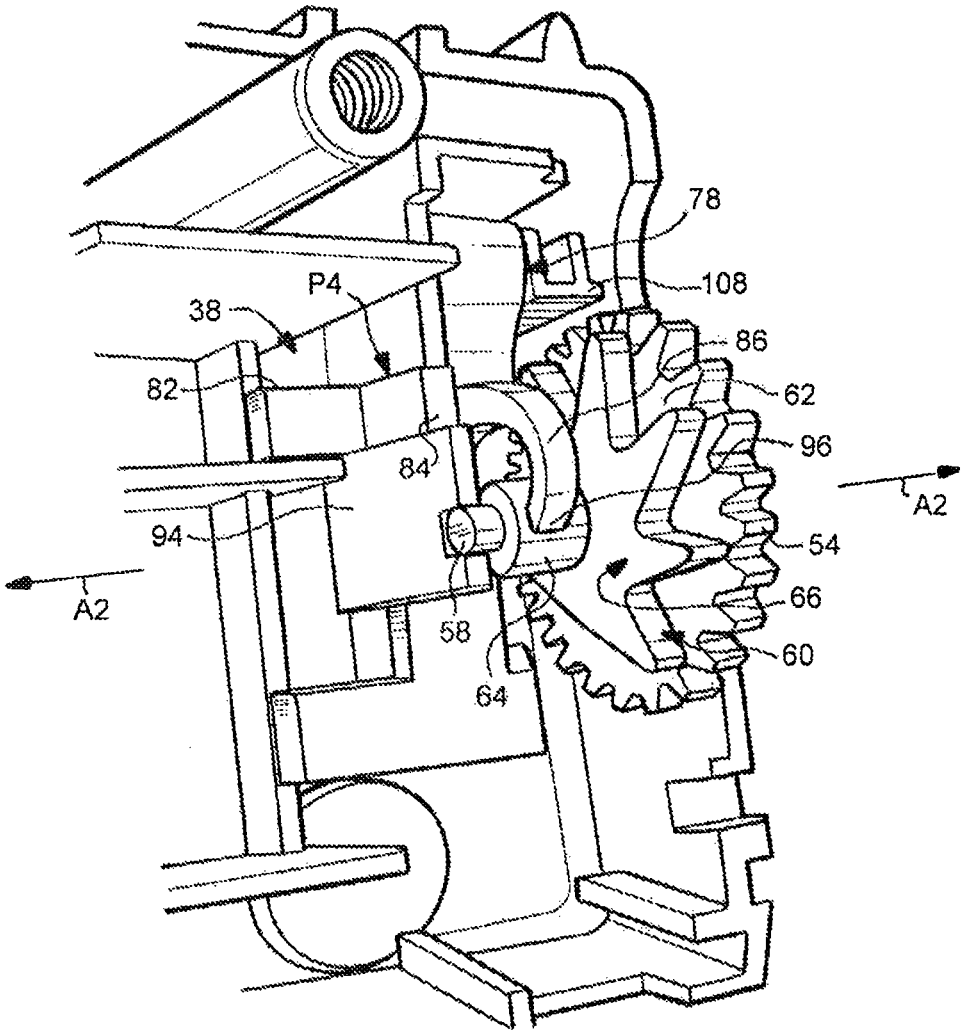
FIG. 6 illustrates another perspective view of some of the components shown in FIG. 4.

Referring to FIG. 6, the central gear 54 is disposed on an axle 58 and rotatable about an axis A2. A cam member 60 is coupled to and extends outwardly from an inner surface 62 of the central gear 54. An extension member 64 is coupled to and extends outwardly from an inner surface 66 of the cam member 60. In one implementation, the central gear 54, cam member 60, and extension member 64 are integrally formed.

Figure 7:
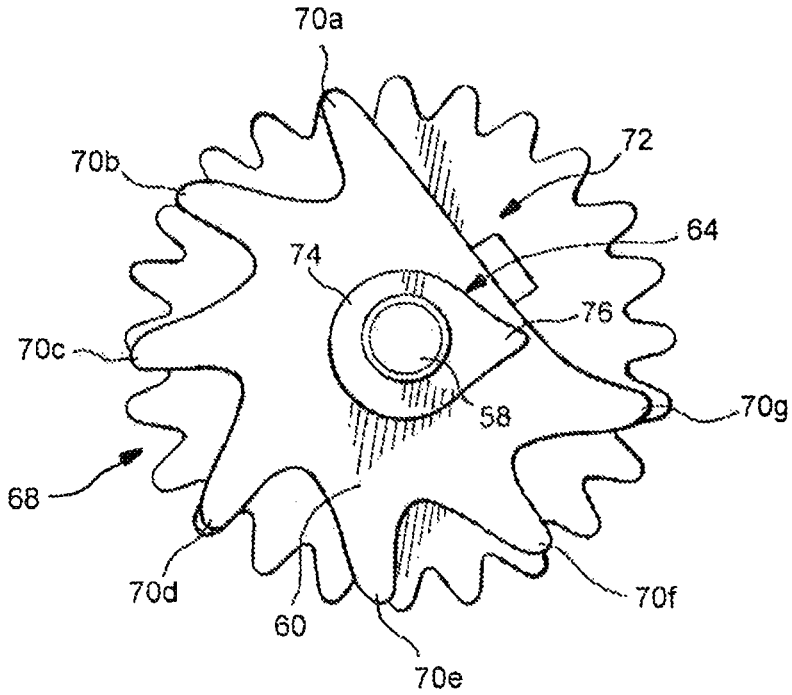
FIG. 7 illustrates a side perspective view of a central gear, cam member and extension member disposed within the cavity of the torso of the toy figure of FIG. 1.

Referring to FIGS. 6 and 7, a portion 68 of the cam member 60 includes a plurality of spaced spokes 70*a*, 70*b*, 70*c*, 70*d*, 70*e*, 70*f*, and 70*g* radiating outwardly from the axle 58. In one implementation, the intermediate spokes 70*b*-70*f* are substantially evenly spaced relative to each other, while the space between the end spokes 70*a* and 70*g* is greater than the spacing between the intermediate spokes 70*b*-70*f*. The space between the end spokes 70*a* and 70*g* defines another portion 72 of the cam member 60, which is substantially planar and without spokes. As shown in FIG. 7, the extension member 64 has a generally teardrop-like configuration, including a base portion 74 extending around and coaxial with the axle 58, and a tip 76 extending outwardly therefrom.

Figure 8:
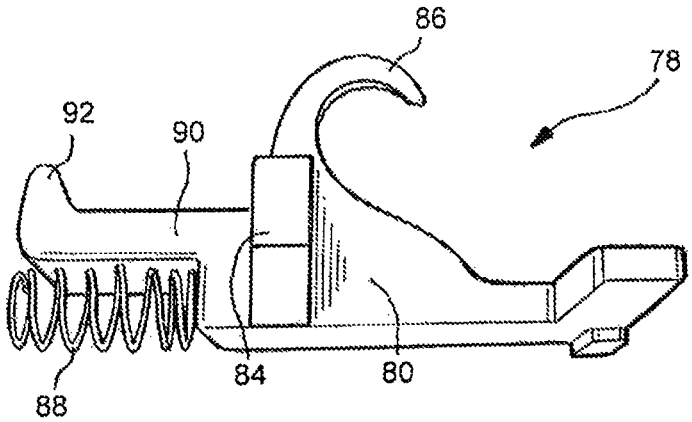
FIG. 8 illustrates a side perspective view of a slide plate disposed within the cavity of the torso of the toy figure of FIG. 1.

Referring to FIGS. 6 and 8, a slide plate 78 is disposed within the cavity 38 proximate to the cam member 60 and extension member 64. The slide plate 78 includes a body 80 movable against an inner surface 82 of the torso 10 and within the cavity 38. A block member 84 extends outwardly from the body 80, and an arm 86 extends upwardly from the body 80. A resilient member, such as a spring 88, is coupled to and extends outwardly from an end portion 90 of the body 80. An end wall 92 extends upwardly from the end portion 90 and the spring 88 is located adjacent the end wall 92.

Figure 9:
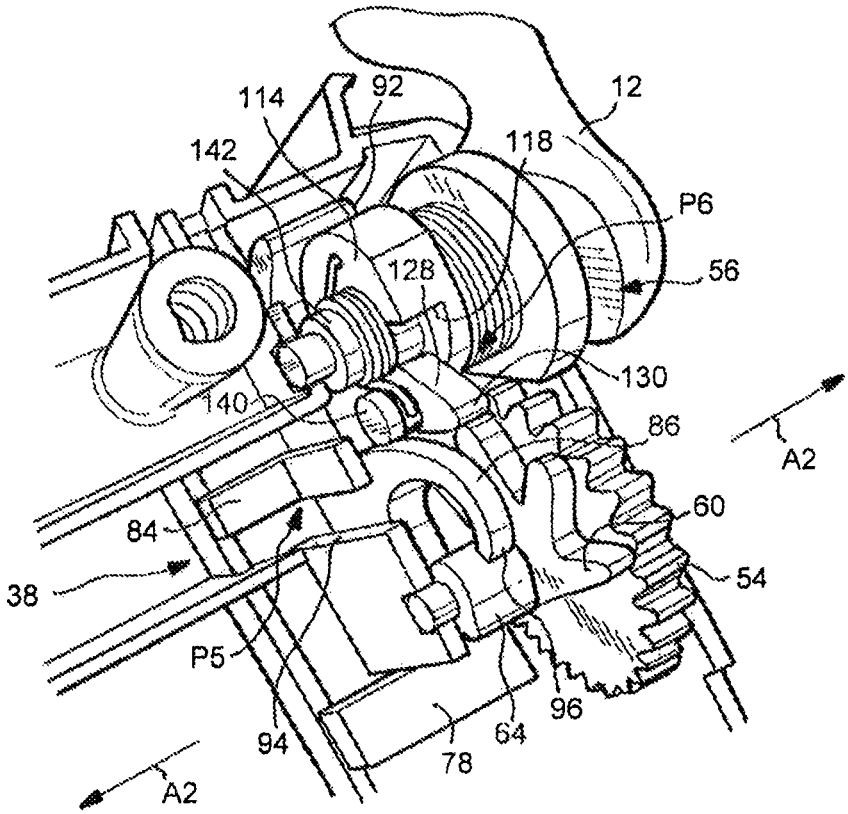
FIG. 9 illustrates a perspective view of internal components disposed within the cavity of the torso of the toy figure of FIG. 1, and showing the slide plate in an engaged position and a cam follower in a raised position.

Referring to FIGS. 5 and 9, the slide plate 78 is linearly movable between an engaged position P4 in which the block member 84 engages a support wall 94 in the cavity 38 (as shown in FIG. 5), and a disengaged position P5 in which the block member 84 is spaced from the support wall 94 (as shown in FIG. 9). The slide plate 78 is biased toward its engaged position P4 contacting the support wall 94 via the spring 88.

With continued reference to FIGS. 5 and 9, the slide plate 78 is positioned within the cavity 38 so that its arm 86 is proximate to the extension member 64. The arm 86 is spaced from the base portion 74 of the extension member 64, but engageable with the tip 76 of the extension member 64. The extension member 64 rotates about its rotational axis A2 (via rotation of the central gear 54), until the tip 76 engages an end 96 of the arm 86 and pushes the arm 86 outwardly and away from the rotational axis A2. The slide plate 78 is thereby linearly moved from its engaged position P4 (shown in FIG. 5) to its disengaged position P5 (shown in FIG. 9). As the extension member 64 continues to rotate about its axis A2, the tip 76 disengages from the end 96 of the arm 86, so that the slide plate 78 is again permitted to slide back to its engaged position P4 via the biasing force of the spring 88.

Figure 10:
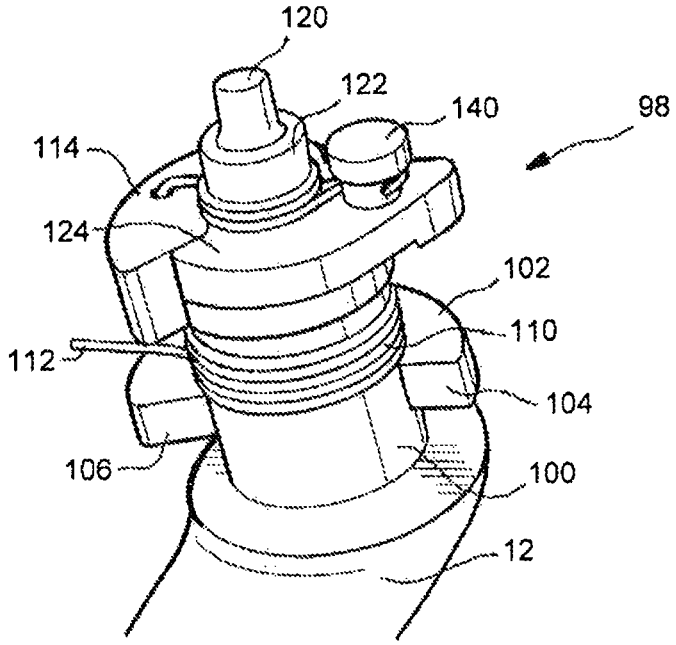
FIG. 10 illustrates a perspective view of a coupling portion of the arm of the toy figure of FIG. 1.

Referring to FIGS. 6, 9 and 10, the end portion 56 of the arm 12 includes a coupling portion 98 extending through a correspondingly configured opening of the torso 10 and into the cavity 38. The coupling portion 98 includes a generally cylindrical stem 100 that is rotatably disposed within the opening of the torso 10, so that the arm 12 is rotatable relative to the torso 10. The coupling portion 98 also includes an inner flange 102 having engagement surfaces 104, 106. The engagement surfaces 104, 106 contact opposing sides of a stop member 108 (shown in FIG. 6) disposed within the cavity 38, thereby limiting the range of rotational movement of the arm 12 relative to the torso 10 between the second arm position P2 and the third arm position P3. A resilient member, such as a spring 110, is disposed around the coupling portion 98 adjacent the inner flange 102, and includes an outwardly extending end portion 112 engageable with the stop member 108, so that the arm 12 is biased toward its third position P3 via the spring 110.

Figure 11:
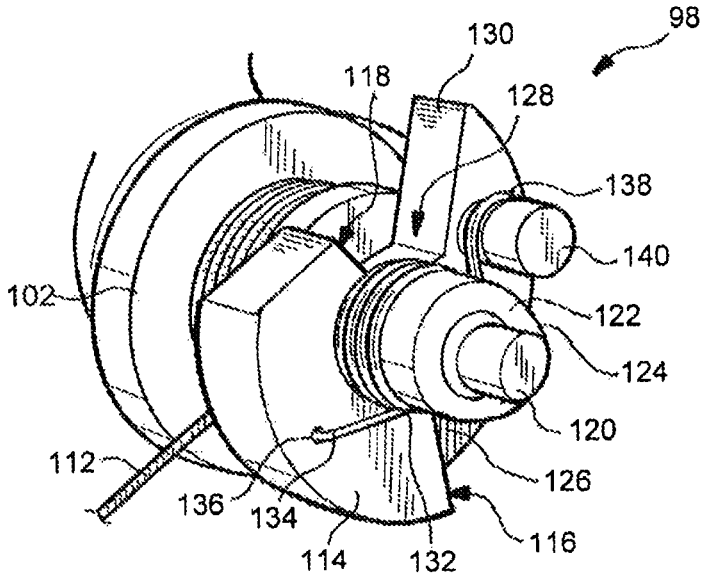
FIG. 11 illustrates another perspective view of the coupling portion of FIG. 10 and viewed from a different orientation.

Referring to FIGS. 10 and 11, the coupling portion 98 further includes an outer flange 114 having spaced contact surfaces 116, 118. An axle 120 extends outwardly from the outer flange 114. A sleeve 122 is rotatably disposed on the axle 120. The sleeve 122 includes an outwardly extending pivot member 124. The pivot member 124 includes an end portion 126 engageable with the contact surface 116 of the outer flange 114, and another end portion 128 engagement with the other contact surface 118 of the outer flange 114. Thus, the range of rotational motion of the sleeve 122 about the axle 120 is limited by engagement between the pivot member 124 and the outer flange 114. A cam follower 130 is defined by or coupled to the end portion 128 of the pivot member 124.

Another resilient member, such as a spring 132, is disposed around the sleeve 122. The spring 132 includes an end 134 coupled to the outer flange 114 (e.g. inserted into an opening 136 provided in the outer flange 114) and another end 138 coupled to the pivot member 124 (e.g. wrapped around a projection 140 extending from the pivot member 124). The end portion 126 of the pivot member 124 is biased against the contact surface 116 of the outer flange 114 via the spring 132, but movable against the force of the spring 132 so that the end portion 126 is spaced from the contact surface 116.

Operation of the movement cycle will now be described with reference to FIGS. 4, 5 and 9. Referring first to FIG. 4, the central gear 54 is rotated via rotation of the drive gear 50 (e.g. upon actuation of the pull string 46). Rotation of the central gear 54, in turn, causes the cam member 60 and extension member 64 to rotate. Referring next to FIGS. 5 and 9, when the arm 12 is in a lowered position relative to the torso 10 (such as in its third position P3), an outer surface 142 of the outer flange 114 contacts the end wall 92 of the slide plate 78 and forces the slide plate 78 to its disengaged position P5 (as shown in FIG. 9). Thus, the slide plate 78 is tensionably retained in its disengaged position P5 against the force of the spring 88 via the engagement between the outer flange 114 and the end wall 92.

In addition, when the arm 12 is in a lowered position relative to the torso 10 (e.g. its third arm position P3), the cam follower 130 is oriented in a raised position P6 (shown in FIG. 9) and disengaged from the cam member 60. In this way, initiation of the movement cycle is restricted unless the arm 12 is disposed in a raised position (e.g. its first arm position P1), given the cam follower 130 is rotated away from the cam member 60 when the arm 12 is rotated downwardly toward its third arm position P3.

As the arm 12 is rotated upwardly from its third arm position P3 toward its first arm position P1, the cam follower 130 rotates downwardly toward the cam member 60. However, the cam follower 130 remains disengaged from the cam member 60 until the arm 12 has been fully moved to its first arm position P1 due to contact between the projection 140 on the pivot member 124 against the arm 86 of the slide plate 78 (shown in FIG. 9). The outer flange 114, however, is permitted to continue its rotation as the arm 12 is moved upwardly toward its first arm position P1 given the space between the end portion 128 of the pivot member 124 and the contact surface 118 of the outer flange 114. The outer flange 114 and arm 12 are thus rotated against the biasing force of the spring 132 and spring 110 of the coupling portion 98.

Referring to FIG. 5, when the arm 12 has been raised to its first arm position P1, the outer surface 142 of the outer flange 114 is no longer engaging the end wall 92 of the slide plate 78. As a result, the slide plate 78 slides back to its engaged position P4 via the tensioning force of the spring 88. With the slide plate 78 in its engaged position P4, its arm 86 no longer blocks the projection 140 of the pivot member 124. As a result, the cam follower 130 of the pivot member 124 snaps into a lowered position P7 (see FIG. 5) due to the tensioning force of the spring 132.

In its lowered position P7, the cam follower 130 engages the spokes 70*a*-70*g* of the cam member 60 in succession as the cam member 60 rotates. As the spokes 70*a*-70*g* of the cam member 60 sequentially contact the cam follower 130, the end portion 126 of the pivot member 124 is pushed against the contact surface 116 of the outer flange 114, causing the outer flange 114 and thus the coupling portion 98 to rotate, so that the arm 12 is moved in direction D1 from its first arm position P1 to its second arm position P2 (shown in FIG. 2) against the biasing force of the spring 110 of the coupling portion 98. Continued rotation of the cam member 60 moves the engaging one of the spokes 70*a*-70*g* past the cam follower 130, so that the pivot member 124 is no longer pushed against the outer flange 114. As a result, the arm 12 moves back from its second arm position P2 toward its first arm position P1 in the opposite direction D2 (shown in FIG. 2). However, the arm 12 is restricted from moving in direction D2 past its first arm position because the contact surface 116 of the outer flange 114 engages and is blocked by the end wall 92 of the slide plate 78 when the slide plate 78 is its in engaged position P4 (shown in FIG. 5). Thus, the arm 12 is mechanically blocked from further rotational movement in direction D2 due to the engagement between the end wall 92 of the slide plate 78 and the outer flange 114.

Thus, as the cam follower 130 engages each of the spokes 70*a*-70*g* of the cam member 60, the arm 12 reciprocates back and forth between its first arm position P1 and its second arm position P2. The arm may thus reciprocate back and forth a plurality of times (e.g. two or more times) between its first and second arm positions P1, P2 during a first segment of the movement cycle. The arm 12 continues to reciprocate between its first and second arm positions P1, P2 during the first segment of the movement cycle when the cam follower 130 is aligned with the corresponding portion 68 of the cam member 60.

Referring again to FIGS. 5 and 7, the tip 76 of the engagement member 64 is aligned with the planar portion 72 of the cam member 60. As the cam member 60 continues to rotate, the tip 76 of the engagement member 64 contacts the end 96 of the arm 86 of the slide plate 78, thereby pushing the arm 86 and thus the slide plate 78 from its engaged position P4 (shown in FIG. 5) to its disengaged position P5 (shown in FIG. 9). As a result, the contact surface 116 of the outer flange 114 is no longer engaging the end wall 92 of the slide plate 78. The outer surface 142 of the outer flange 114 slides against the end wall 92, so that the slide plate 78 is again retained in its disengaged position P5. In turn, the cam follower 130 of the pivot member 124 is rotated from its lowered position P7 (shown in FIG. 5) back to its raised position P6 (shown in FIG. 9).

The arm 12 is thereby permitted to snap forward in direction D2 from its second arm position P2 to its third arm position P3 (as shown in FIG. 2) due to the biasing force of the spring 110 during a second segment of the movement cycle. Due to the rapid movement of the arm 12 and distance of travel along its second path of motion M2, the hat 28 (if mounted on the hand) is detached from the hand 14 and launched forward and away from the toy figure T1. The movement cycle may be repeated by re-actuating the drive assembly (e.g. extending the pull string 46) and ensuring that the arm 12 is in its raised, first arm position P1.

Figure 12:
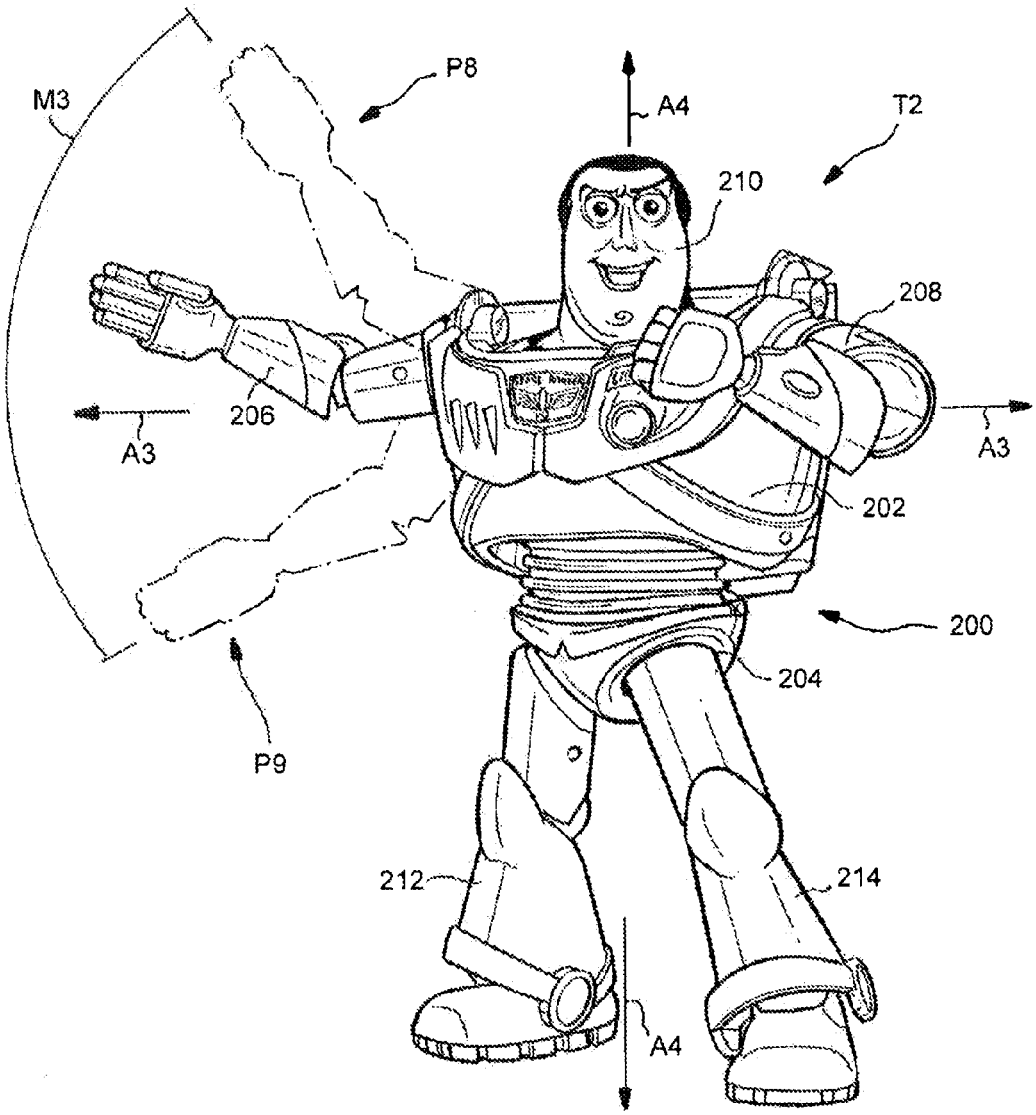
FIG. 12 illustrates a front perspective view of a toy figure according to another embodiment.

A toy figure T2 according to another embodiment is illustrated in FIG. 12. The toy figure T2 includes a body 200 having an upper portion 202 movably coupled to a lower portion 204. In addition, an arm 206 is movably coupled to the upper portion 202 of the body 200. A drive assembly 218 (shown in FIG. 13 and described in further detail below) reciprocally moves the arm 206 relative to the upper portion 202 of the body 200, and simultaneously reciprocally moves the upper portion 202 of the body 200 relative to the lower portion 204 of the body 200. The arm 206 pivots about an axis A3 extending through the body during movement thereof, resembling a chopping motion, and the upper portion 202 pivots about another axis A4, which is substantially vertical, during movement thereof. In one embodiment, axis A3 is substantially perpendicular to axis A4.

The toy figure T2 may further include another arm 208 that is rotatably or fixedly coupled to the upper portion 202 of the body 200, and a head 210 rotatably or fixedly coupled to the upper portion 202 of the body 200. The lower portion 204 of the body 200 includes legs 212, 214. The toy figure T2 may be configured to resemble an action figure having an outer space or super hero type theme. In other embodiments, the toy figure T2 may have alternative configurations and/or themes.

Figure 13:
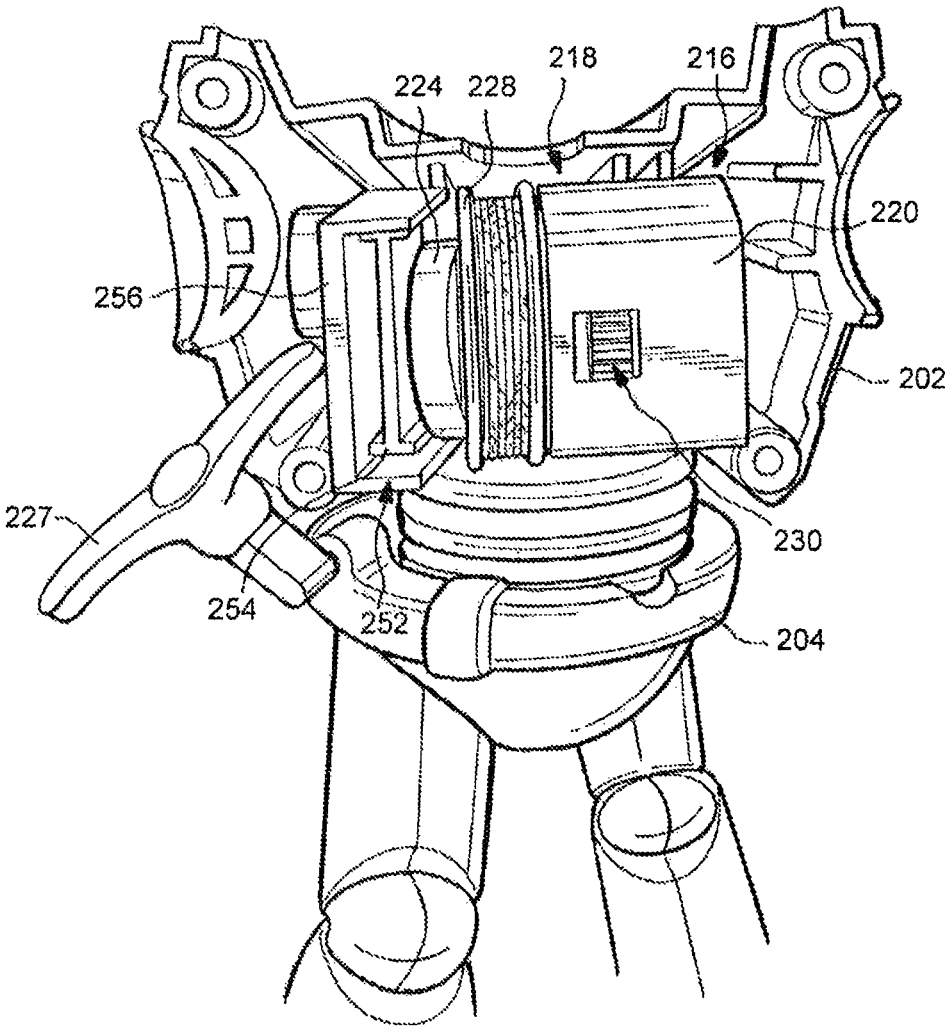
FIG. 13 illustrates a front perspective view of internal components within a cavity of the toy figure of FIG. 12.
Figure 14:
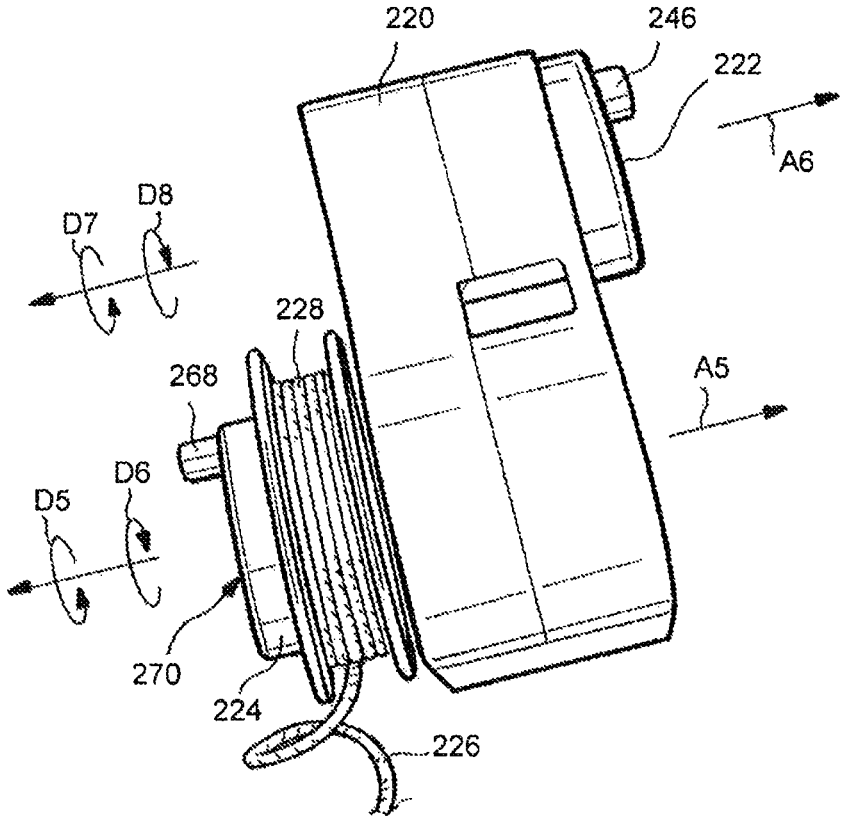
FIG. 14 illustrates a perspective view of a housing and first and second drive wheels of the drive assembly for the toy figure of FIG. 12.

Referring to FIG. 13, the upper portion 202 of the body 200 defines a cavity 216 configured for housing the drive assembly 218. Referring to FIGS. 13 and 14, the drive assembly 218 includes a housing 220 and first and second drive wheels 222, 224. The first drive wheel 222 is coupled to and reciprocally moves the arm 206 relative to the upper portion 202 of the body 200. The second drive wheel 224 is coupled to and reciprocally moves the upper portion 202 relative to the lower portion 204 of the body 200.

In one embodiment, the drive assembly 218 includes a spring-biased pull string 226. A spool 228 around which the pull string 226 is coiled is rotatably coupled to the housing 220. A distal end of the pull string 226 may be attached to a pull member 227 (see FIG. 13) configured to be grasped by a user when uncoiling the pull string 226. The second drive wheel 224 is coupled to the spool 228, so that the second drive wheel 224 is also rotatable relative to the housing 220. The second drive wheel 224 is rotatably biased in a direction D5 about a rotational axis A5 thereof via a resilient member, such as a spring, which is disposed within the housing 220. The pull string 226 may be pulled outwardly and uncoiled from the spool 228, thereby causing the second drive wheel 224 to rotate in an opposite direction D6 about its rotational axis A5 against the biasing force of the spring. Upon release of the pull string 226, the pull string 226 is recoiled around the spool 228. The second drive wheel 224 is thereby rotated in the direction D5 due to the biasing force of the spring. The rotational speed of the second drive wheel 224 about the rotational axis A5 is determined in part by the biasing force of the spring, as well a gearing arrangement 230 (see FIG. 13) disposed within the housing 220 and coupled to the spool 228 and the second drive wheel 224.

Figure 15:
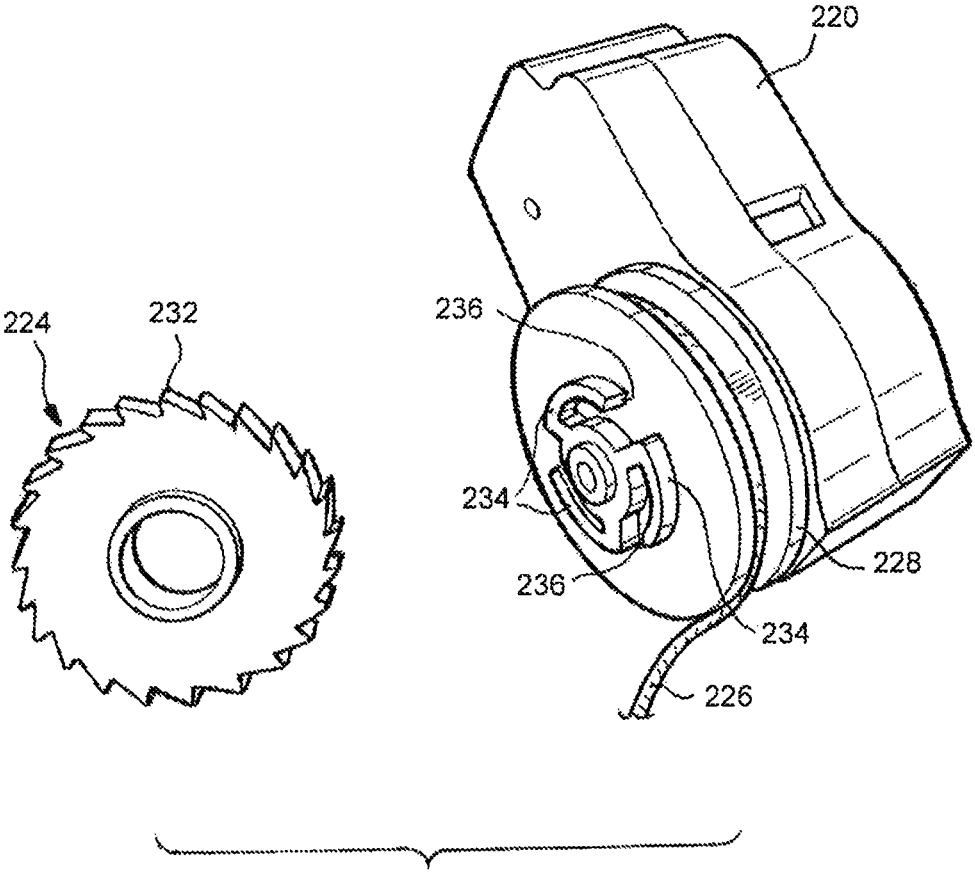
FIG. 15 illustrates another perspective view of the components shown in FIG. 14, and showing the second drive wheel detached from the housing.

Referring to FIG. 15, in one embodiment, the second drive wheel 224 includes a ridged inner surface 232 that cooperates with arcuate bars 234 extending outwardly from or coupled to the spool 228. Each of the bars 234 includes an angled end 236, which slide over the ridged inner surface 232 when the spool 228 rotates in direction D6. The second drive wheel 224 is thereby permitted to remain stationary as the spool rotates in direction D6 (such as when the pull string 226 is being unwound). However, the angled ends 236 of the bars 234 engage the ridged inner surface 232 when the spool rotates in direction D5, so that the second drive wheel 224 and spool 228 rotate together in direction D5. In this way, movement of the upper portion 202 of the body 200 relative to the lower portion 204 may be restricted (such as when a child is grasping the toy figure T2) as the pull string 226 is being uncoiled from the spool 228. Thus, the ridged inner surface 232 and cooperating bars 234 act as a clutch, allowing movement of the second drive wheel 224 relative to the spool 228 in only direction D6.

Referring again to FIG. 14, the first drive wheel 222 is also coupled to the spool 228 via another gearing arrangement (not shown) disposed within the housing 220. Thus, the first drive wheel 222 is rotatable relative to the housing 220 upon actuation of the pull string 226. The first drive wheel 222 is rotated in a direction D7 about a rotational axis A6 as the pull string 226 is uncoiled from the spool 228, and then rotated in an opposite direction D8 about its rotational axis A6 as the pull string 226 is recoiled about the spool 228. The rotational speed of the first drive wheel 222 is determined in part by the biasing force of the spring, as well as the gearing arrangement coupling the first drive wheel 222 to the spool 228.

In one embodiment, the gearing arrangements within the housing 220 are configured so that the first drive wheel 222 rotates about its rotational axis A6 at a first speed, and the second drive wheel 224 rotates about its rotational axis A5 at a second speed different than the first speed. As a result, the arm 206 is caused to reciprocally move along a travel path M3 (see FIG. 12), pivoting about axis A3 between a raised position P8 (shown in phantom in FIG. 12) and a lowered position P9 (shown in phantom in FIG. 12) at one speed, while the upper portion 202 of the body 200 is caused to reciprocally pivot back and forth about axis A4 relative to the lower portion 204 at a different speed. In one implementation, the first speed is greater than the second speed, so that the arm 206 rapidly moves in a chopping motion, while the upper portion 202 of the body 200 slowly pivots back and forth relative to the lower portion 204 of the body 200.

Figure 16:
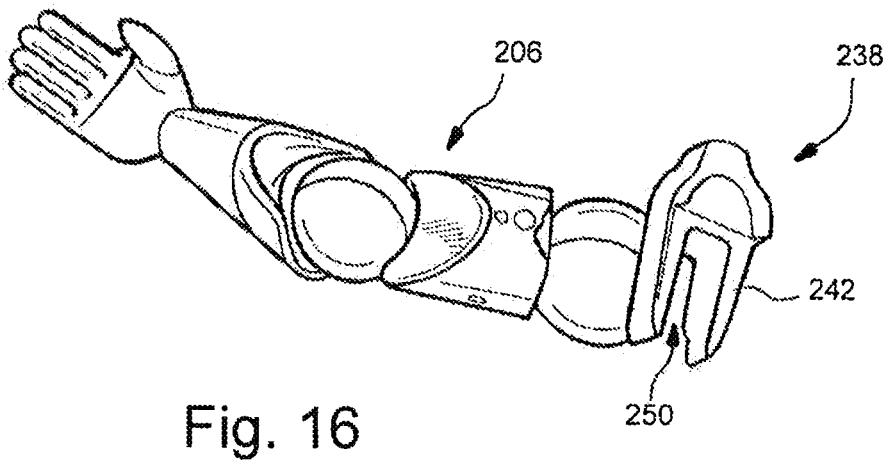
FIG. 16 illustrates a perspective view of an arm of the toy figure of FIG. 12.
Figure 17:
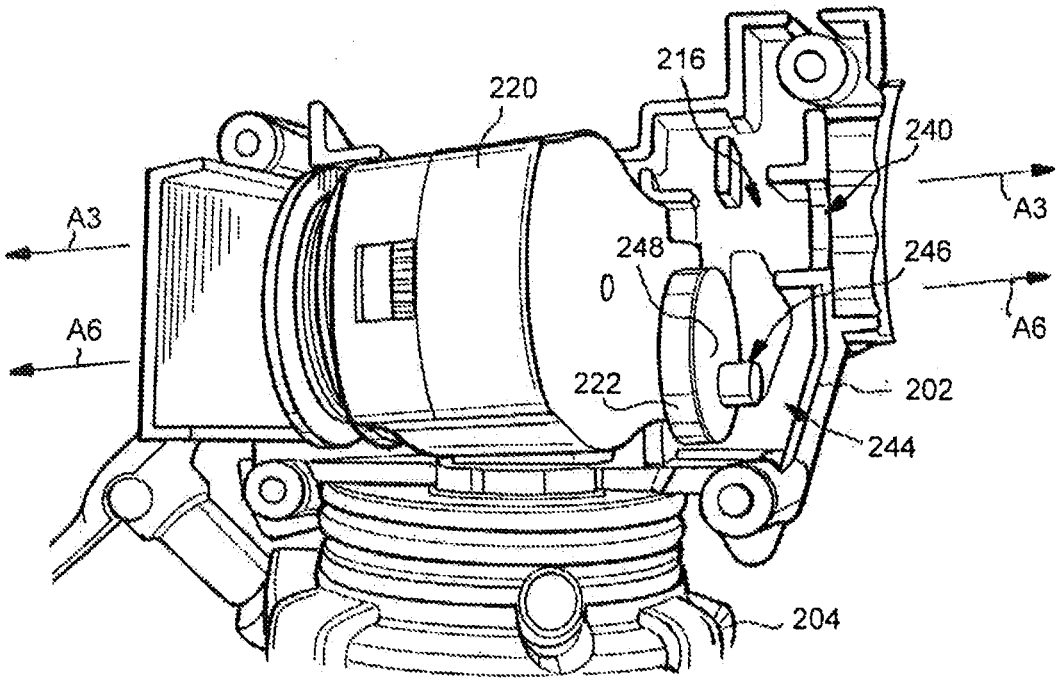
FIG. 17 illustrates another perspective view of internal components of the toy figure of FIG. 12, and showing the first drive wheel.

Referring to FIGS. 16 and 17, the arm 206 includes an end portion 238 receivable through a correspondingly configured opening 240 (see FIG. 17) in the upper portion 202 and disposed within the cavity 216. The end portion 238 includes an extension member 242 disposed within a portion 244 of the cavity 216 that permits pivotal motion of the extension member 242 about axis A3. The housing 220 is oriented within the cavity 216 of upper portion 202 of the body 200 so that the first drive wheel 222 is aligned with the extension member 242. The first drive wheel 222 includes a projection 246 extending outwardly from a surface 248 thereof. The projection 246 is received in a channel 250 defined by the extension member 242. The channel 250 has a sufficient length to permit the projection 246 to slide back and forth between opposing ends thereof as the first drive wheel 222 rotates. The extension member 242 is caused to pivot back and forth about its rotational axis A3 as the first drive wheel 222 rotates, given the projection 246 is offset from the rotational axis A6 of the first drive wheel 222. As the extension member 242 is reciprocally moved back and forth, the arm 206 is caused to rapidly pivot back and forth (due to the gearing arrangement providing for relatively rapid rotation of the first drive wheel 222). The arm 206 is thereby caused to move in a rapid chopping motion.

Figure 18:
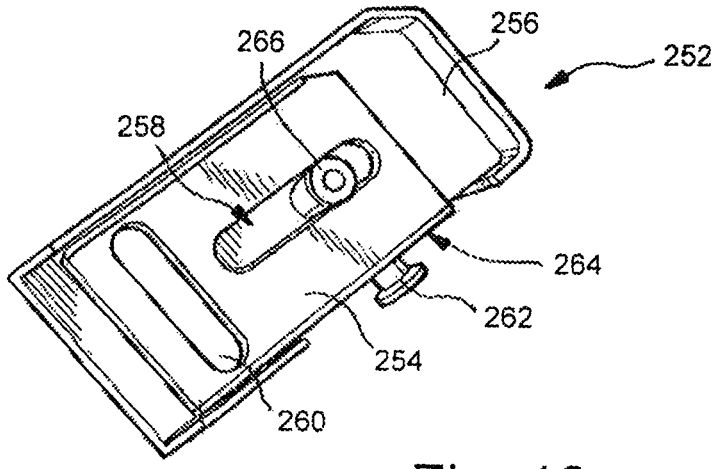
FIG. 18 illustrates a perspective view of a slide assembly of the internal components for the toy figure of FIG. 12.
Figure 19:
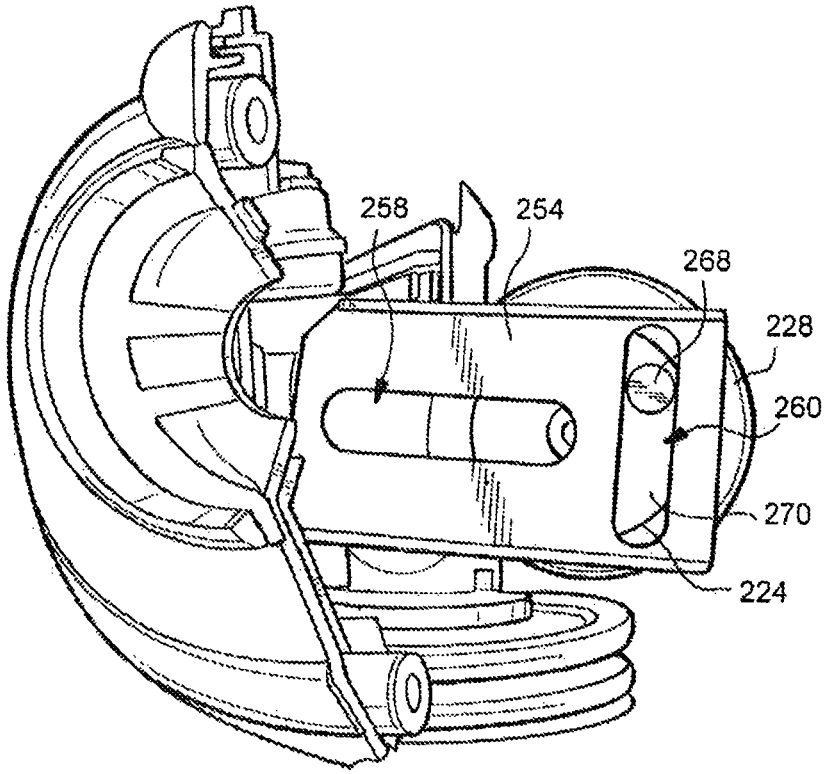
FIG. 19 illustrates another perspective view of internal components of the toy figure of FIG. 12, and showing the second drive wheel and portions of the slide assembly.

Referring again to FIG. 13, the second drive wheel 224 is coupled to a slide assembly 252. Referring to FIGS. 13 and 18, the slide assembly 252 includes a plate 254 disposed within and slidable against a cover member 256. The plate 254 defines a horizontal slot 258 and a vertical slot 260. A protrusion 262 extends outwardly from a lower edge 264 of the plate 254. The cover member 256 includes a projection 266, which is slidably disposed within the horizontal slot 258. The housing 220 is oriented within the cavity 216 of the upper portion 202 so that the second drive wheel 224 is aligned with the plate 254, as shown in FIGS. 13 and 19. The second drive wheel 224 includes a projection 268 extending outwardly from a surface 270 thereof (also shown in FIG. 14).

Referring again to FIG. 19, the projection 268 is received in the vertical slot 260. The vertical slot 260 has a sufficient length to permit the projection 268 to slide back and forth between opposing ends thereof as the second drive wheel 224 rotates. The plate 254 is caused to slide back and forth relative to the cover member 256 in opposing directions as the second drive wheel 224 rotates, given the projection 268 is offset from the rotational axis A5 of the second drive wheel 224 (shown in FIG. 14).

Figure 20:
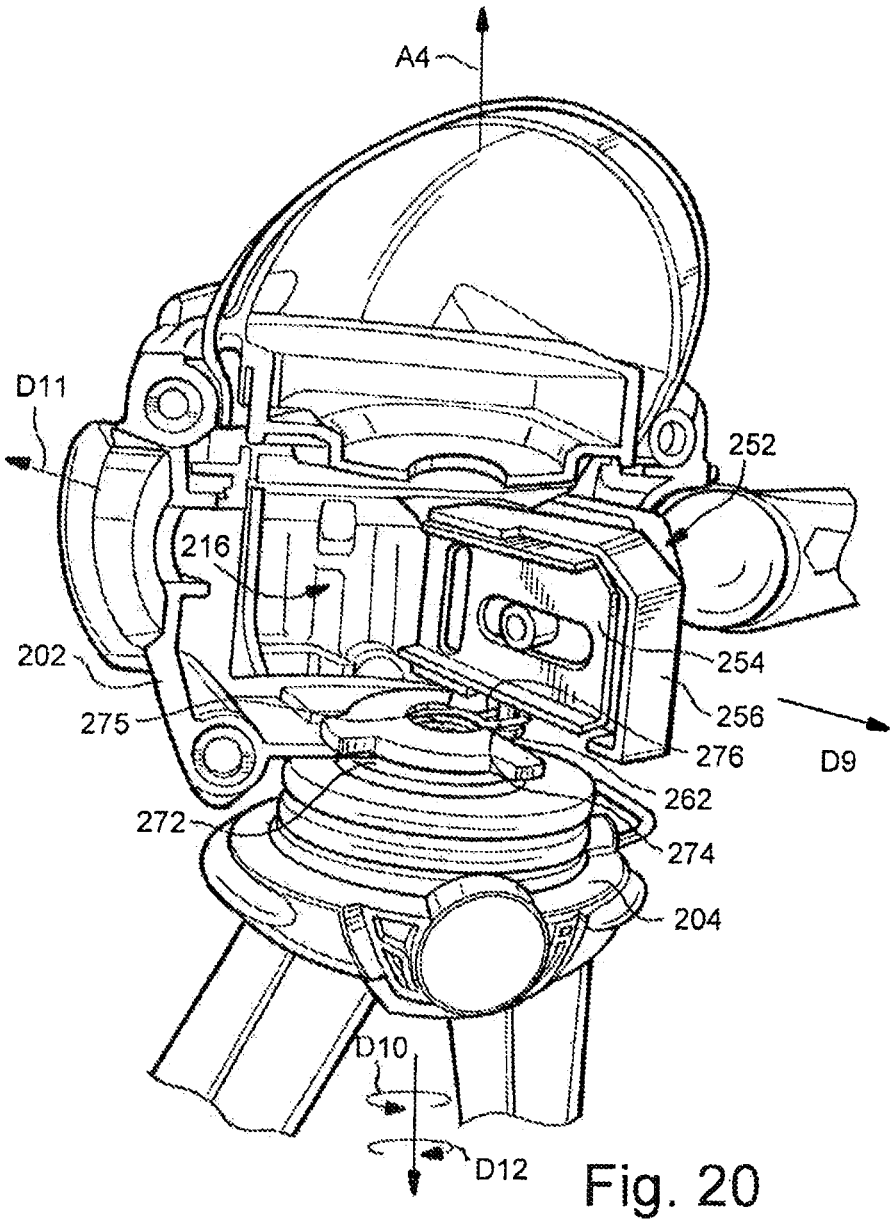
FIG. 20 illustrates another perspective view of internal components of the toy figure of FIG. 12, and showing the orientation of the slide assembly within the cavity thereof.
Figure 21:
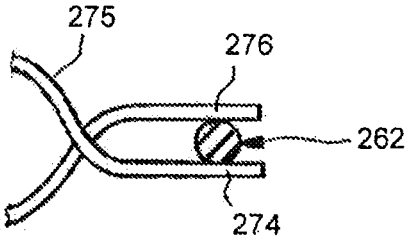
FIG. 21 illustrates a close-up partial top view of some components of FIG. 20.

Referring to FIG. 20, the upper portion 202 of the body 200 is coupled to a post 272 coupled to and extending upwardly from the lower portion 204. The upper portion 202 is rotatable about the vertical axis A4, as described above. Resilient members 274, 276, such as two ends of a spring 275, extend outwardly from the post 272. The slide assembly 252 is disposed within the cavity 216 of the upper portion 202 so that the protrusion 262 of the plate 254 is disposed between the resilient members 274, 276 as shown in the close-up partial view of FIG. 21.

As the second drive wheel 224 rotates, the plate 254 slides back and forth relative to the cover member 256. As the plate 254 slides in a direction D9 toward the front of the toy figure T2, the protrusion 262 pushes against a biasing force of the resilient member 274, which translates into a rotational force so that the upper portion 202 of the body 200 rotates relative to the lower portion 204 in a direction D10 about axis A4. As it is continued to be moved, the plate 254 then slides in an opposite direction D11 toward the rear of the toy figure T2, so that the protrusion 262 then pushes against a biasing force of the other resilient member 276. The biasing force of the resilient member 276 translates into a rotational force so that the upper portion 202 of the body 200 rotates relative to the lower portion 204 in an opposite direction D12 about axis A4.

In this way, the upper portion 202 of the body 200 reciprocally moves back and forth as the second drive wheel 224 continuously rotates about its axis A5. The speed of reciprocal movement of the upper portion 202 relative to the lower portion 204 is slower than the speed of the chopping motion of the arm 206 due to the gearing arrangements within the housing 220 of the drive assembly 218. In alternative embodiments, the relative speeds of the motion patterns (e.g. arm chopping and body rotation) may be the same, or the chopping motion may be slower compared to the body rotation.

Thus, a single pull string drive assembly reciprocally moves the arm 206 relative to the upper portion 202 of the body 200, while also simultaneously moving the upper portion 202 relative to the lower portion 204 of the body 200. Further, the speed and range of chopping motion of the arm 206 is different than the speed and range of motion of the pivotal motion of the upper portion 202.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy figure comprising:

a body;

an arm movably coupled to the body; and a drive mechanism coupled to the arm, the drive mechanism reciprocally moving the arm along a first path of motion during a first movement cycle back and forth between a first arm position and a second arm position, and the drive mechanism including a resilient member that biases the arm toward a third position, such that the arm moves along a second path of motion between the second arm position and the third arm position during a second movement cycle following the first movement cycle, the second path of motion differing from the first path of motion, and the third arm position being located outside of the first path of motion.

2. The toy figure of claim 1, wherein the first path of motion has a first distance, and the second path of motion has a second distance greater than the first distance.

3. The toy figure of claim 1, further comprising:

an accessory detachably coupled to the arm, the accessory detachably coupled to the arm during the first movement cycle, and the accessory detached from and launched by the arm during the second movement cycle.

4. The toy figure of claim 3, further comprising:

a hand connected to the arm, wherein the accessory is a hat detachably mounted on the hand.

5. The toy figure of claim 1, wherein the drive mechanism includes a spring-biased pull string.

6. The toy figure of claim 1, wherein the first path of motion extends between the first arm position and the second arm position, and the second path of motion extends between the second arm position and the third arm position.

7. The toy figure of claim 6, wherein initiation of the first movement cycle is restricted until the arm is disposed in its first arm position.

8. A toy figure, comprising:

a body;

an arm movably coupled to the body; and a drive mechanism coupled to the arm, the drive mechanism moving the arm reciprocally along a first path of motion between a first position and a second position during a first segment of a movement cycle, the arm moving back and forth between the first position and the second position at least twice during the first segment, and the drive mechanism including a resilient member that biases the arm towards a third position, such that the drive mechanism moves the arm along a second path of motion between the second position and the third position during a second segment of the movement cycle, wherein the third position is not in the first segment of the movement cycle.

9. The toy figure of claim 8, further comprising:

an accessory detachably coupled to the arm, the accessory detachably coupled to the arm during the first segment of the movement cycle, and the accessory detached from and launched by the arm during the second segment of the movement cycle.

10. The toy figure of claim 9, further comprising:

a head coupled to the body; and a hand coupled to the arm, wherein the accessory is a hat selectively mountable on the head or on the hand.

11. The toy figure of claim 8, wherein the drive mechanism includes a cam having a first portion and a second portion, and a cam follower, the cam follower engaging the first portion of the cam during the first segment of the movement cycle, and the cam follower aligned with the second portion of the cam during the second segment of the movement cycle.

12. The toy figure of claim 8, wherein initiation of the movement cycle is restricted unless the arm is disposed in its first position.

13. The toy figure of claim 10, wherein the hat includes a cavity and the hat is selectively mountable on the head or on the hand via the cavity.

* * * * *